US008402905B2

(12) United States Patent
Fung

(10) Patent No.: US 8,402,905 B2
(45) Date of Patent: Mar. 26, 2013

(54) KITE SHIP

(75) Inventor: Kwong Kun Fung, Tuen Mum (HK)

(73) Assignee: Lin Feng, ShenZhen, GuangDong Province (CN)

( * ) Notice: Subject to any disclaimer, the term of this patent is extended or adjusted under 35 U.S.C. 154(b) by 197 days.

(21) Appl. No.: 13/002,335

(22) PCT Filed: Sep. 10, 2008

(86) PCT No.: PCT/CN2008/001597

§ 371 (c)(1),
(2), (4) Date: Mar. 15, 2011

(87) PCT Pub. No.: WO2010/000100

PCT Pub. Date: Jan. 7, 2010

(65) Prior Publication Data

US 2011/0162569 A1 Jul. 7, 2011

(30) Foreign Application Priority Data

Jul. 4, 2008 (CN) ..... 2008 1 0068289

(51) Int. Cl.
*B63B 35/00* (2006.01)

(52) U.S. Cl. ..... 114/39.29; 114/39.21; 114/102.1; 114/102.16

(58) Field of Classification Search ..... 114/39.11, 114/39.21, 39.29, 102.1, 102.11, 102.16, 114/102.29, 102.3
See application file for complete search history.

(56) References Cited

U.S. PATENT DOCUMENTS

| | | | | |
|---|---|---|---|---|
| 4,497,272 | A * | 2/1985 | Veazey | 114/102.29 |
| 6,910,434 | B2 * | 6/2005 | Lundgren | 114/102.1 |
| 6,918,346 | B2 * | 7/2005 | Grenier | 114/102.16 |
| 6,925,949 | B1 * | 8/2005 | Phillips | 114/102.1 |
| 7,546,813 | B2 * | 6/2009 | Wrage | 114/102.1 |
| 7,798,083 | B2 * | 9/2010 | Wrage | 114/102.1 |

* cited by examiner

*Primary Examiner* — Lars A Olson

(57) ABSTRACT

A kite ship contains a ship and a kite for pulling the ship, wherein the kite includes a kite main body, the upper and the lower ends of which are respectively connected with an upper and a lower end ropes, the other end of the upper end rope is fixed on a traction apparatus, the other end of the lower end rope is fixed on a connector, a traction apparatus pulling rope is fixed on the traction apparatus; the other end of the traction apparatus pulling rope is wound on a stranding cage connected with a motor through a speed reducer; a tension dynamometer is fixed on the connector; the tension dynamometer connects with a connector pulling rope; the other end of the connector pulling rope is wound on another stranding cage connected with the motor through the speed reducer; a buoyant balloon is arranged on the kite main body.

8 Claims, 5 Drawing Sheets

KITE SHIP

BACKGROUND OF THE INVENTION

1. Field of the Invention

The present invention relates to a kite ship actuated by wind.

2. Description of the Prior Art

A conventional ship is actuated by wind, but related parts and structures are complicated, therefore it is difficult to operate the conventional ship.

CN Patent Publication No. 86201968U discloses a kite capable of flying in the sky automatically, and this kite is an airplane toy comprised of plastic pieces, and the plastic pieces are connected together by ways of a heat connecting machine, forming a hydrogen kite. The kite includes an air balloon with a hole to spray air to the kite, actuating the kite to move.

CN Patent Publication No. 1256164A discloses a light kite comprised of al least one balloon and a body, wherein the balloons are connected on the kite or fixed on the kite by using a net cover or fixed in a cavity or a frame.

The present invention has arisen to mitigate and/or obviate the afore-described disadvantages.

SUMMARY OF THE INVENTION

The primary object of the present invention is to provide a kite ship that is actuated by wind to save energy source and to be operated easily.

A kite ship provided the present invention contains:

a kite and a ship, wherein the kite including a kite main body, and the kite main body includes at least one upper end rope connected with an upper end thereof and at least one lower end rope coupled with a lower end thereof, one end of the upper end rope is fixed on a traction apparatus, one end of the lower end rope is fixed on a connector, the traction apparatus includes the traction apparatus pulling rope, one end of the traction apparatus pulling rope is wound on a stranding cage connected with a motor through a speed reducer, the connector includes a tension dynamometer connecting with a connector pulling rope, one end of the connector pulling rope is inserted wound on another stranding cage connected with another motor through another speed reducer;

the kite main body includes at least one buoyant balloon.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
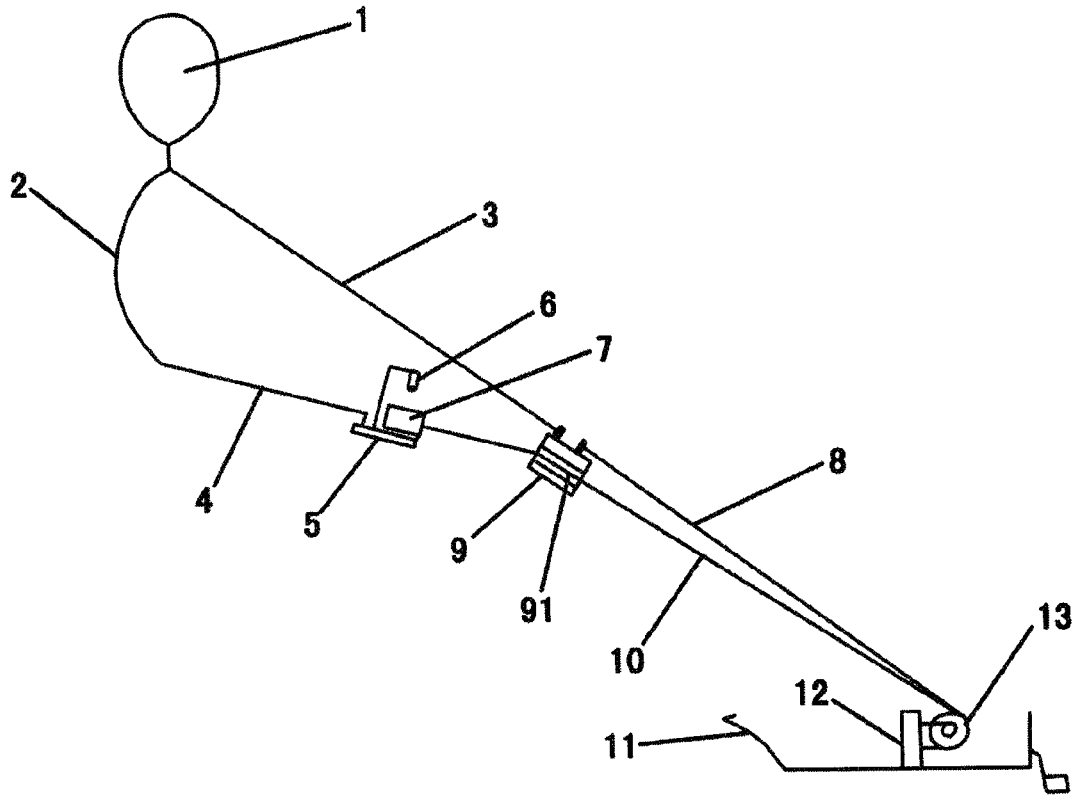
FIG. 1 is a plan view showing the assembly of a kite ship in accordance with a preferred embodiment of the present invention.
Figure 2:
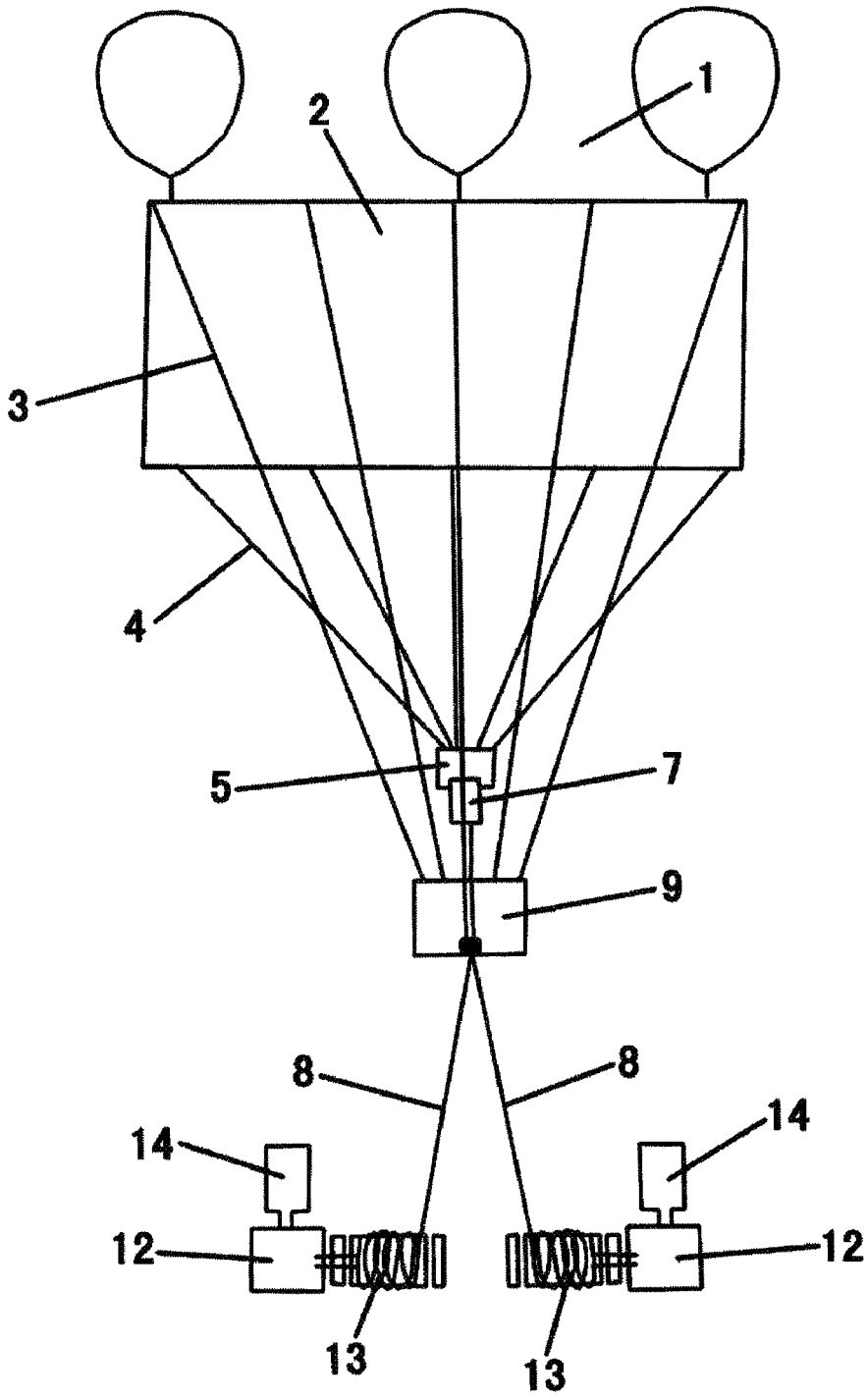
FIG. 2 is a plan view showing the assembly of a kite in accordance with the preferred embodiment of the present invention.
Figure 3:
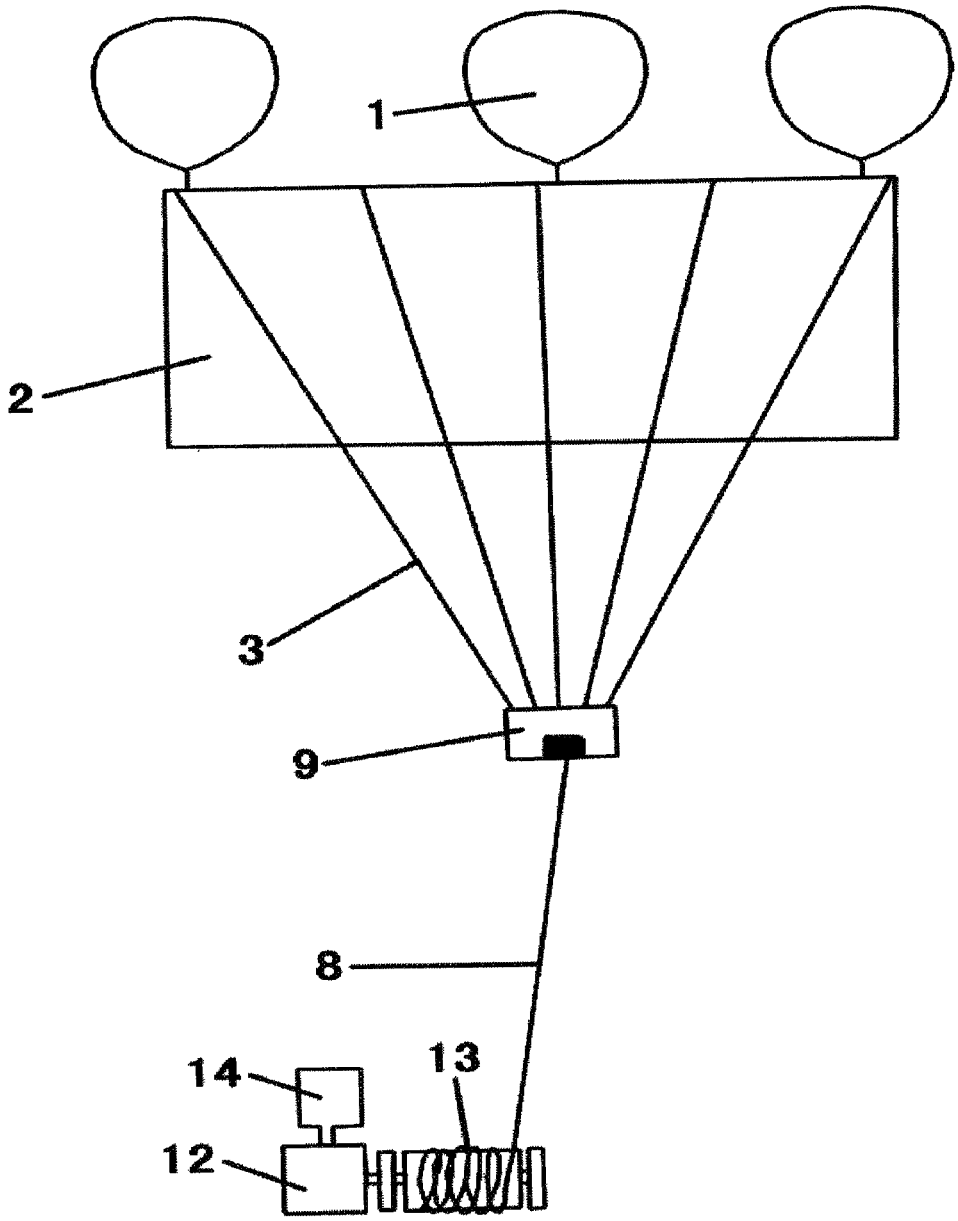
FIG. 3 is a plan view showing the assembly of a part of a kite in accordance with the preferred embodiment of the present invention.
Figure 4:
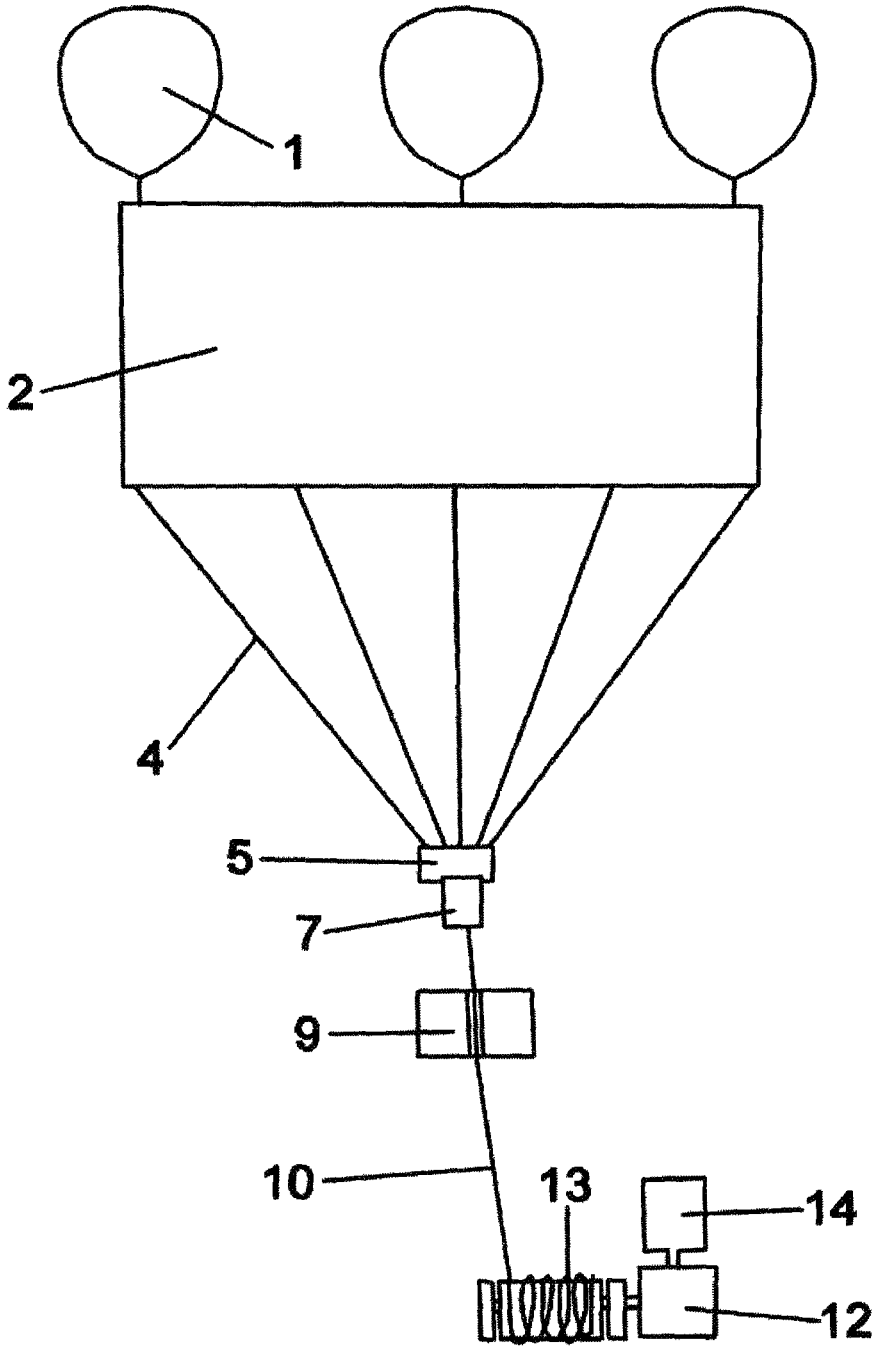
FIG. 4 is a plan view showing the assembly of another part of the kite in accordance with the preferred embodiment of the present invention.
Figure 5:
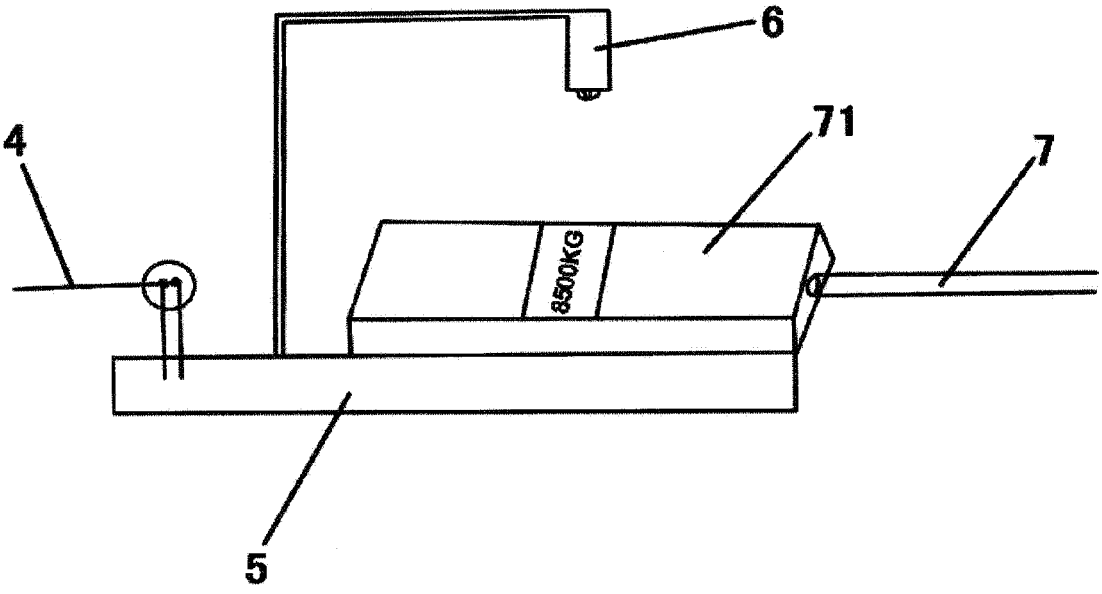
FIG. 5 is a plan view showing the assembly of a connector in accordance with the preferred embodiment of the present invention.

Referring to FIGS. 1 and 2, a kite ship according to a preferred embodiment of the present invention comprises a kite and a ship 11, wherein the kite is comprised of at least one buoyant balloon 1, a kite main body 2, an upper end rope 3, a lower end rope 4, a connector 5, a traction apparatus pulling rope 8, a traction apparatus 9, and a connector pulling rope 10, wherein at least one buoyant balloon 1 (such as a hydrogen balloon or a helium balloon) is connected with a top end of the kite main body 2 made of a fiberglass material, the kite main body 2 is used to face wind or to shelter wind, and the kite main body 2 includes a plurality of upper end ropes 3 made of a fiberglass material or a reinforcement martial and includes a number of lower end ropes 4 made of a fiberglass material or a reinforcement martial, one end of the upper end rope 3 is fixed on the traction apparatus 9, one end of the lower end rope 4 is fixed on the connector 5, the traction apparatus 9 includes the traction apparatus pulling rope 8 made of a fiberglass material or a reinforcement martial, one end of the traction apparatus pulling rope $ is wound on a stranding cage 13 connected with a motor 14 through a speed reducer 12, and the speed reducer 12 is fixed on the ship 11, the connector 5 includes a tension dynamometer 7 and a camera 6, a camera head of the camera 6 is aligned with a screen 71 of the tension dynamometer 7, the screen 71 is provided to display a tension value, the tension dynamometer 7 includes the connector pulling rope 10 made of a fiberglass material or a reinforcement martial, one end of the connector pulling rope 10 is inserted through a hole 91 of the traction apparatus 9 to be wound on another stranding cage 13 connected with another motor 14 through another speed reducer 12 which is fixed on the ship 11, such that the motor 14 pulls the lower end rope 4 of the kite main body 2 based on the value of the tension dynamometer 7 to change a wind facing angle from 60 degrees to 115 degrees of the kite main body 2, thus adjusting a wind force. The camera 6 transmits the value of the tension dynamometer 7 to a control center of the ship by using a wireless transmitter module.

In operation, the hydrogen balloon, the traction apparatus pulling rope, and the kite main body are released, and then the motor is started in an anti-clockwise direction to further release the traction apparatus pulling rope to the sky so that the hydrogen balloon and the kite pull the kite main body and the traction apparatus pulling rope to move to the sky. After releasing the traction apparatus pulling rope to the sky for five minutes, the another motor is started in the anti-clockwise direction so that the traction apparatus pulling rope is released and actuated by the kite main body to move to the sky.

The kite main body is adjusted to 60 degrees (it is the largest wind facing angle), wherein the motor rotates in a clockwise and an anti-clock angles to adjust and control the angle of the kite main body.

Due to the tension dynamometer is fixed on the kite, and the value of the tension of the tension dynamometer is transmitted by the wireless transmitter module, hence the pull force of the kite is known clearly.

The motor is started in the anti-clockwise direction to release the traction apparatus pulling rope toward 120 degrees and to lower a wind resistance, stopping the traction apparatus pulling rope to move. Thereafter, the motor is started in the clockwise direction to pull the traction apparatus pulling rope and the kite main body back, and then the another motor is started in the clockwise direction to pull the traction apparatus pulling rope and the kite main body back, hence the two motors pull the kite back together.

While we have shown and described various embodiments in accordance with the present invention, it is clear to those skilled in the art that further embodiments may be made without departing from the scope of the present invention.

What is claimed is:

1. A kite ship comprising:

a kite and a ship, wherein the kite including a kite main body, and the kite main body includes at least one upper end rope connected with an upper end thereof and at least one lower end rope coupled with a lower end thereof, one end of the upper end rope is fixed on a traction apparatus, one end of the lower end rope is fixed on a connector, a traction apparatus includes the traction apparatus pulling rope, one end of the traction apparatus pulling rope is wound on a stranding cage connected with a motor through a speed reducer, the connector includes a tension dynamometer connecting with a connector pulling rope, one end of the connector pulling rope is inserted wound on another stranding cage connected with another motor through another speed reducer;

wherein the kite main body includes at least one buoyant balloon.

2. The kite ship as claimed in claim 1, wherein the connector includes a camera, a camera head of the camera is aligned with a screen of the tension dynamometer, the screen is provided to display a tension value, the camera transmits the value of the tension dynamometer to a control center of the ship.

3. The kite ship as claimed in claim 1, wherein one end of the connector pulling rope is inserted through a hole of the traction apparatus to be wound on another stranding cage.

4. The kite ship as claimed in claim 1, wherein a number of the buoyant balloon is more than one.

5. The kite ship as claimed in claim 1, wherein the kite main body is released or pulled back by using the lower end rope to change a wind facing angle.

6. The kite ship as claimed in claim 5, wherein the wind facing angle of the kite main body is between 40 degrees to 180 degrees.

7. The kite ship as claimed in claim 1 or 4, wherein the buoyant balloon is selected from a hydrogen balloon and a helium balloon.

8. The kite ship as claimed in claim 1, wherein the kite main body is made of a fiberglass material.

* * * * *